US008621831B2

(12) United States Patent
Moylan et al.

(10) Patent No.: US 8,621,831 B2
(45) Date of Patent: Jan. 7, 2014

(54) ROBOTIC MAIL TRAY SLEEVER APPARATUS

(75) Inventors: Thomas Patrick Moylan, Eagle, NE (US); Timothy A. Mischnick, Omaha, NE (US); Francis J. Buglewicz, Bellevue, NE (US); Troy Robert Power, Lincoln, NE (US)

(73) Assignee: Capstone Technologies LLC, Omaha, NE (US)

( * ) Notice: Subject to any disclaimer, the term of this patent is extended or adjusted under 35 U.S.C. 154(b) by 94 days.

(21) Appl. No.: 12/779,335

(22) Filed: May 13, 2010

(65) Prior Publication Data

US 2011/0030318 A1 Feb. 10, 2011

Related U.S. Application Data

(60) Provisional application No. 61/216,114, filed on May 14, 2009.

(51) Int. Cl.

| | |
|---|---|
| ***B65B 59/00*** | (2006.01) |
| ***B65B 5/02*** | (2006.01) |
| ***B65B 5/04*** | (2006.01) |
| ***B65B 43/30*** | (2006.01) |
| ***B65B 43/41*** | (2006.01) |

(52) U.S. Cl.

USPC ..... 53/504; 53/168; 53/169; 53/564; 53/585; 53/202; 53/250; 53/258

(58) Field of Classification Search

CPC ..... B65B 59/00; B65B 5/04; B65B 43/305; B65B 43/265; B65B 5/024; B65H 3/44; B31B 2201/027; B31B 1/06

USPC ..... 53/503, 504, 168, 169, 564, 566, 580, 53/585, 202, 249–252, 255, 258, 259

IPC ..... B65B 43/24, 43/26, 43/30, 43/32, 43/41, B65B 5/02

See application file for complete search history.

(56) References Cited

U.S. PATENT DOCUMENTS

| | | | | |
|---|---|---|---|---|
| 2,082,565 | A * | 6/1937 | Benoit | 53/169 |
| 3,665,674 | A * | 5/1972 | Bivans et al. | 53/202 |
| 4,041,850 | A * | 8/1977 | Reichert | 493/310 |
| 4,930,291 | A * | 6/1990 | Buisseau | 53/168 |
| 5,105,600 | A * | 4/1992 | DePoint, Jr. et al. | 53/168 |
| 5,214,904 | A * | 6/1993 | DePoint et al. | 53/169 |

(Continued)

FOREIGN PATENT DOCUMENTS

| | | | | |
|---|---|---|---|---|
| DE | 19510669 | A1 * | 10/1996 | B65B 43/26 |
| EP | 392478 | A1 * | 10/1990 | B65B 5/02 |

(Continued)

*Primary Examiner* — Stephen F Gerrity
(74) *Attorney, Agent, or Firm* — Advent, LLP

(57) ABSTRACT

A novel method and apparatus for placing trays into sleeves is provided. The apparatus includes a conveyor system for transporting a mail tray, a sleeve blank presentment device and a robotic arm. The robotic arm is provided with an end of arm tool which retains and opens a sleeve blank. A tray induction system including a plurality of paddles configured to guide a tray into an open sleeve blank is also provided.

20 Claims, 19 Drawing Sheets

(56) References Cited

U.S. PATENT DOCUMENTS

| | | | | | |
|---|---|---|---|---|---|
| 5,379,570 | A * | 1/1995 | Terjung et al. | ..... | 53/169 |
| 5,481,854 | A | 1/1996 | Van Newkirk | | |
| 5,588,276 | A * | 12/1996 | Terjung et al. | ..... | 53/169 |
| 7,758,292 | B2 * | 7/2010 | Close et al. | ..... | 414/412 |
| 2003/0040413 | A1 * | 2/2003 | Malecki et al. | ..... | 493/309 |
| 2004/0040262 | A1 * | 3/2004 | Palumbo | ..... | 53/504 |
| 2007/0204567 | A1 * | 9/2007 | Wintring et al. | ..... | 53/564 |
| 2010/0170202 | A1 * | 7/2010 | Bray et al. | ..... | 53/444 |

FOREIGN PATENT DOCUMENTS

| | | | | | |
|---|---|---|---|---|---|
| GB | 2349625 | A * | 11/2000 | ..... | B65B 43/26 |
| JP | 07257502 | A * | 10/1995 | ..... | B65B 5/00 |
| JP | 07257503 | A * | 10/1995 | ..... | B65B 5/00 |
| JP | 10100084 | A * | 4/1998 | ..... | B65B 35/00 |
| JP | 2000006909 | A * | 1/2000 | ..... | B65B 5/06 |
| WO | WO 9906283 | A1 * | 2/1999 | ..... | B65B 5/02 |

* cited by examiner

ROBOTIC MAIL TRAY SLEEVER APPARATUS

CROSS REFERENCE TO RELATED APPLICATION

This application is a non-provisional of U.S. Application Ser. No. 61/216,114 filed on May 14, 2009, titled ROBOTIC MAIL TRAY SLEEVER METHOD AND APPARATUS which is incorporated by reference herein in its entirety.

BACKGROUND OF THE INVENTION

The present application relates generally to systems for automating repetitive tasks. In particular, the present application relates to the automated handling and sleeving of mail trays for routing bulk mailings and other articles.

The U.S. Postal Service (USPS) allows high volume postal customers to reduce their mailing costs and the delivery time for their mail by presorting, packaging and labeling their mail to reduce handling costs incurred by the USPS. According to the program, customers should sort the mail for a particular zip code destination, and load the sorted mail in a standard size tray. The trays must be sleeved in a cardboard cover. The sleeved tray is weighed to determined postal charges, and tagged with information on the weight, zip code and destination for the USPS. The tagged, sleeved tray is strapped, and finally delivered to the USPS.

The mail is packaged in standard sized mail trays and paperboard sleeves and securely banded. The trays for first and third class mail are in three different sizes designated MM, 4½ inches high, 10½ wide and 24 inches long, and EMM, 6½ high and 11½ wide and 24 inches long. Additionally, Half MM trays are available which have the same height and width as a Full MM tray but are 12 inches long. The sleeves are rectangular cardboard tubes provided in three sizes to accommodate the three standard trays. Customers receive the sleeves as flat, folded blanks. Unfolding a sleeve blank to open it to a tube and inserting a mail tray in the sleeve is a labor intensive operation. Accordingly, there is a need, for an automatic system that can insert a mail tray into a sleeve as part of a larger mail handling system.

One obstacle to an automatic sleeving system relates to the ability of a system to store, feed and form sleeves reliably. The condition of the sleeves is a factor in mail packaging systems. To keep costs low, used sleeves are returned to customers and are reused as long as they are structurally intact. Over its useful lifetime, a sleeve is subject to wear and tear that can cause it to become creased and torn, and the edges and corners become frayed and dog-eared. The condition of a used sleeve makes it difficult for an automatic system to handle the sleeve to reliably obtain it from a supply device, unfold it to a proper shape and position it for inserting of a tray.

One known mail tray sleeving system is the AUTOSLEEVE system available from Carter Control Systems of Frederick, Md. and described in U.S. Pat. No. 5,481,854. This system design has been widely adopted. While this system was an improvement when introduced, it still has practical limitations.

The system described in the '854 patent includes a single, vertical stack of sleeve blanks where only the uppermost of the sleeve blanks in the stack is available for use by the system. Alternatively, two systems may be used in parallel such that trays of each particular size are directed to the sleeving system configured to handle trays of that size. This represents a significant increase in capital investment to operate the system. Also, in practice, the system is advertised as capable of only sleeving 18 mail trays per minute. This cyclic rate is further reduced by the fact that the system must be stopped to replenish the supply of sleeve blanks to the sleever which results in a lower overall throughput.

Accordingly, there is a need for a system capable of sleeving mail trays and capable of handling mail trays of multiple sizes at a single station without the intervention of a human operator. There is a further need for a sleeving system capable of sleeving mail trays at a higher throughput than what is currently achieved. There is yet a further need to provide an automatic sleeving system wherein the supply of sleeve blanks can be replenished without interrupting the operation of the system.

SUMMARY

This application relates to a novel method for placing trays into sleeves. The method includes the steps of positioning the tray into a staging zone, and gripping an unopened sleeve with a robotic arm and end of arm tool. The sleeve is opened or formed with the end of arm tool. The opened sleeve is placed into a ready position proximate to a tray induction system with the robotic arm. The opened sleeve is then secured in a ready position with mechanical devices. The end of arm tool may then release the opened sleeve. The tray is then inserted into the opened sleeve using other mechanical devices. After the tray has been sleeved, the sleeved tray is cleared away from the tray induction system.

This application also relates to a robotic mail tray sleeving system. The system includes a conveyor system for transporting a mail tray, a sleeve blank presentment device and a robotic arm. The robotic arm is provided with an end of arm tool which retains and opens a sleeve blank. A tray induction system including a plurality of paddles configured to guide a tray into an open sleeve blank is also provided.

This application further relates to a novel method for handling articles including the steps of positioning a tray of articles for inserting the tray in a sleeve and gripping an uppermost sleeve blank from a supply of sleeve blanks. The gripped sleeve blank is moved to a position below the supply and formed into a sleeve. The formed sleeve is positioned to accept a tray.

DETAILED DESCRIPTION

Figure 1:
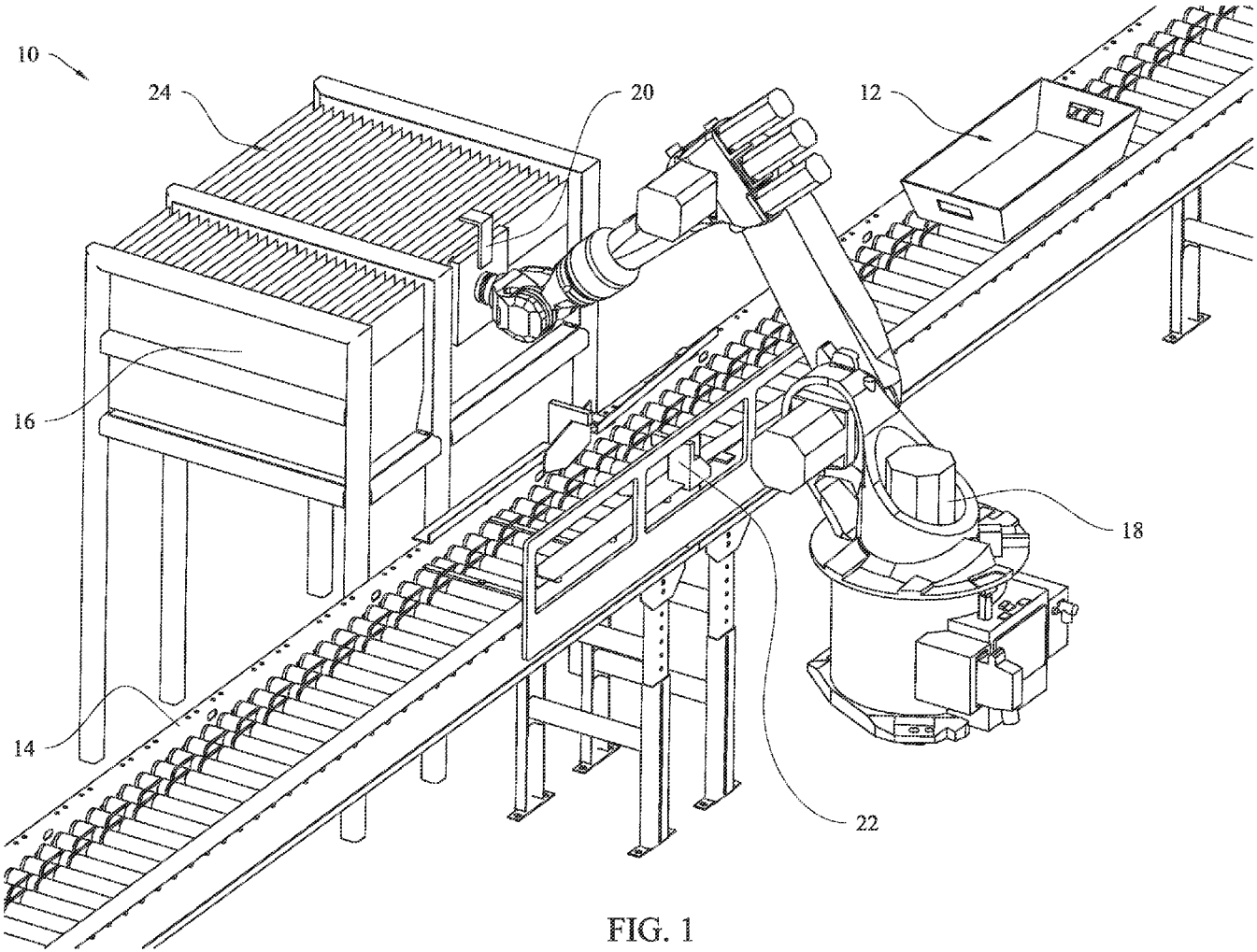
FIG. 1, is a perspective view of a robotic mail tray sleeving system.

Referring to the Figures, FIG. 1 shows an exemplary embodiment of a robotic mail tray sleeving system 10 for sleeving a mail tray 12. System 10 includes a conveyor system 14, a sleeve blank presentment device 16, a robotic arm 18, having end of arm tooling 20, and a tray induction system 22. Conveyor system 14 transports tray 12 to a position proximate to sleeve blank presentment system 16. Robotic arm 18 grasps a sleeve blank 24, opens the sleeve blank to form a sleeve and positions the opened sleeve proximate to induction system 22. Robotic arm 18 then releases sleeve 24 and tray 12 is positioned inside sleeve 24 before moving downstream of system 10.

Conveyor system 14 may be specialized as shown herein. Sleeve blank presentment device 16 is shown as two side-by-side rectangular holders for providing sleeves of two different sizes to system 10. An operator may restock each of the holders "on the fly" such that system 10 operates continuously during restocking. This allows for a higher average cyclic rate for the system as it operates over time. Robotic arm 18 is shown as a six axis robotic arm, but a multi axis robotic arm may also be used. The numerous degrees of freedom available in this design allow for greater tolerances during installation as any variation in actual relative position of the robotic arm 18 to conveyor system 14, sleeve blank presentment device 16, and tray induction system 22 may be corrected by altering the program controlling robotic arm 18 after installation.

Figure 2:
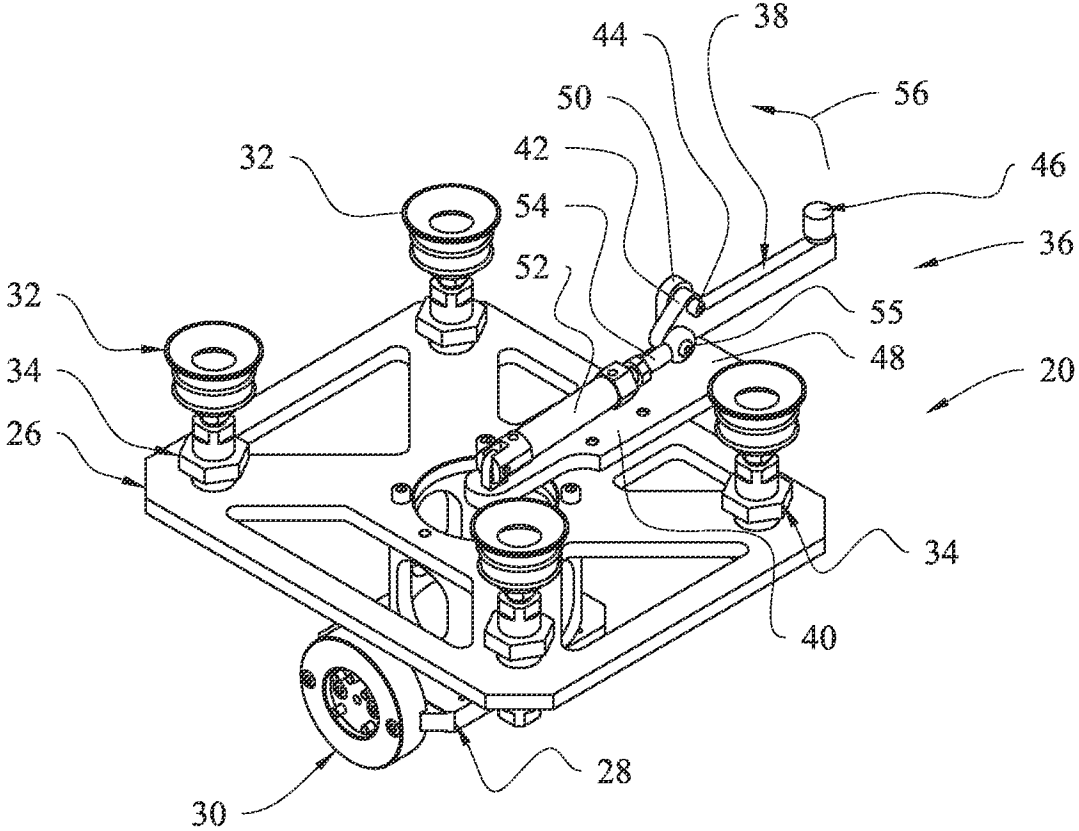
FIG. 2, is a plan perspective view of an end of arm tool.
Figure 3:
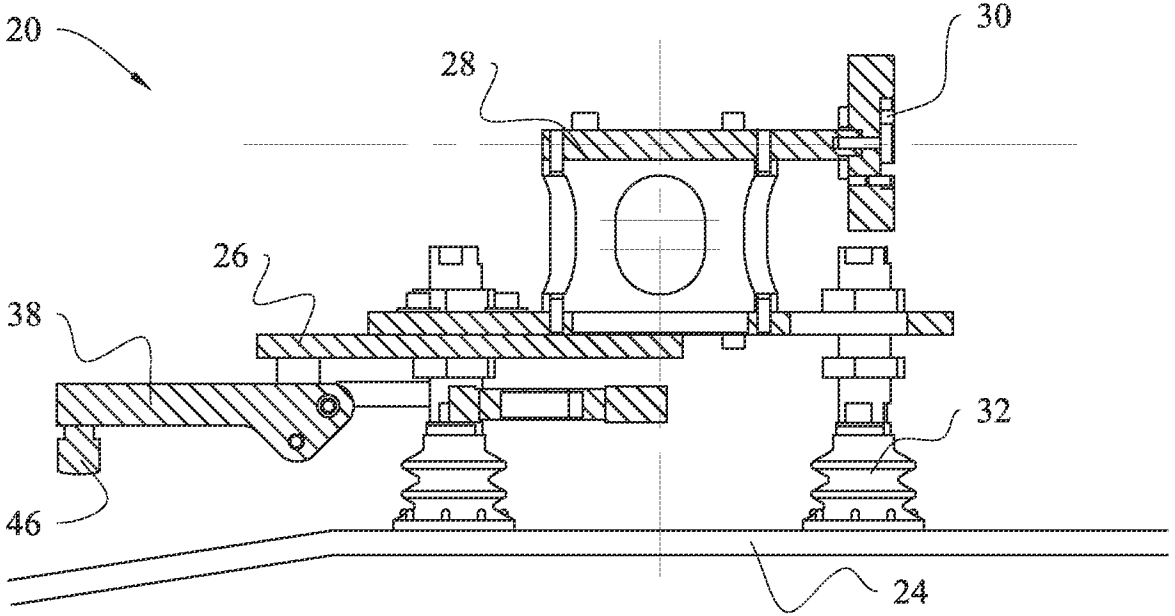
FIG. 3, is a crossectional view of the end of arm tool of FIG. 2 engaging a sleeve.
Figure 4:
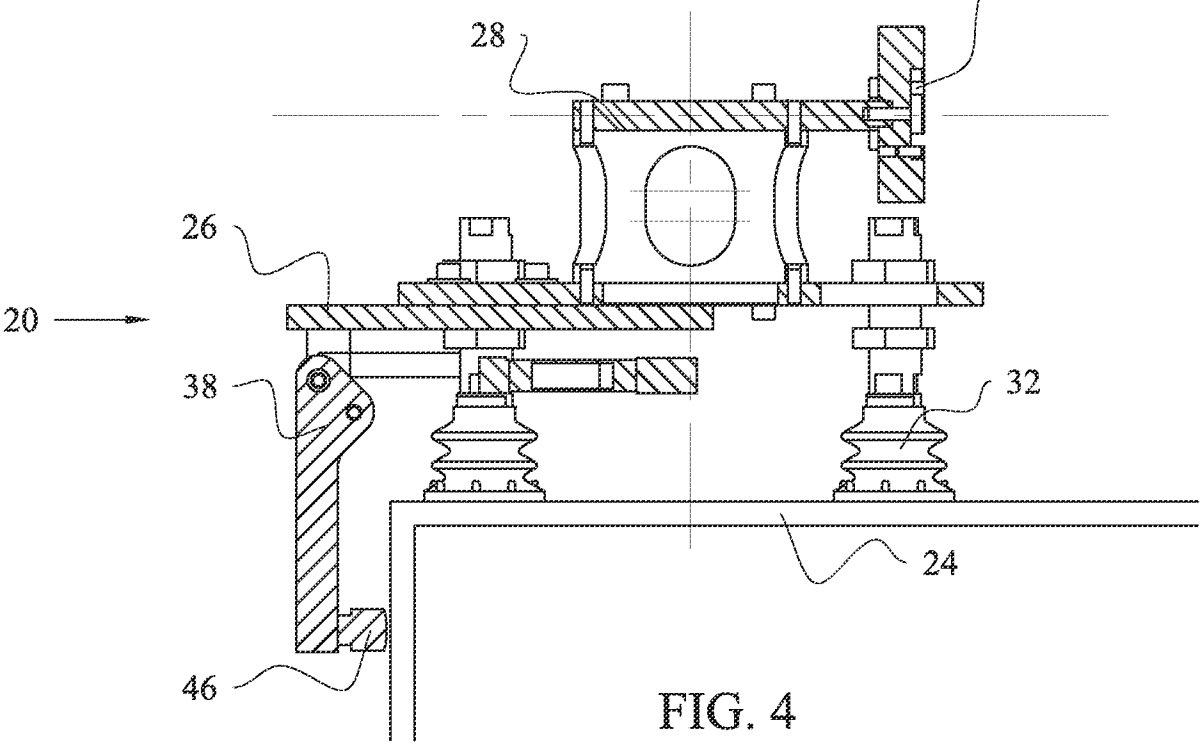
FIG. 4 is another crossectional view of the end of arm tool of FIG. 2 engaging a sleeve and maintaining the sleeve in an open position.

Referring to FIGS. 2-4, end of arm tooling 20 may generally include a base plate 26, a robotic arm adapter 28, a coupler 30, suction heads 32, suction head couplers 34, and sleeve opening system 36. Each of suction heads 32 are coupled to base plate 26 by suction head couplers 34. Each suction head may be in fluid communication with its own air supply for creating a partial vacuum. Alternatively, all four suction heads may be in fluid communication with the same air supply. End of arm tooling 20 may be coupled to robotic arm 18 (shown in FIG. 1) at coupler 30.

Sleeve opening system 36 may be coupled to base plate 26 by any of a variety of means including welding or fastening. Sleeve opening system 36 includes an arm 38 and a base 40. Arm 38 includes a first end comprising a cam portion 42 having an aperture 44 that comprises the pivot point of cam portion 42. Aperture 44 is positioned to be a working portion of cam portion 42 that may be engaged to move a second end of arm having a contact 46 at a point distal to cam portion 42. Base portion 40 may comprise a plate portion 48 and an extension 50 through which aperture 44 also passes. Arm 38 may be pivotally coupled to extension 50 by a pin, rivet, or other fastening means. Actuator 52 urges a rod 54 that is engaged to arm 38 at aperture 55 such that substantially linear motion of rod 54 translates to an arcuate motion of contact 46 about aperture 44 and along path 56. Thus, when actuator 52 urges rod 54 contact 46 is pivoted in a plane perpendicular to the plane defined by base plate 26. Actuator 52 and rod 54 may comprise pneumatic piston, a screw drive, or any other known means of translating substantially linear motion into arcuate motion. Alternatively, other drive systems could be used including belts, chains and other devices.

Figure 5:
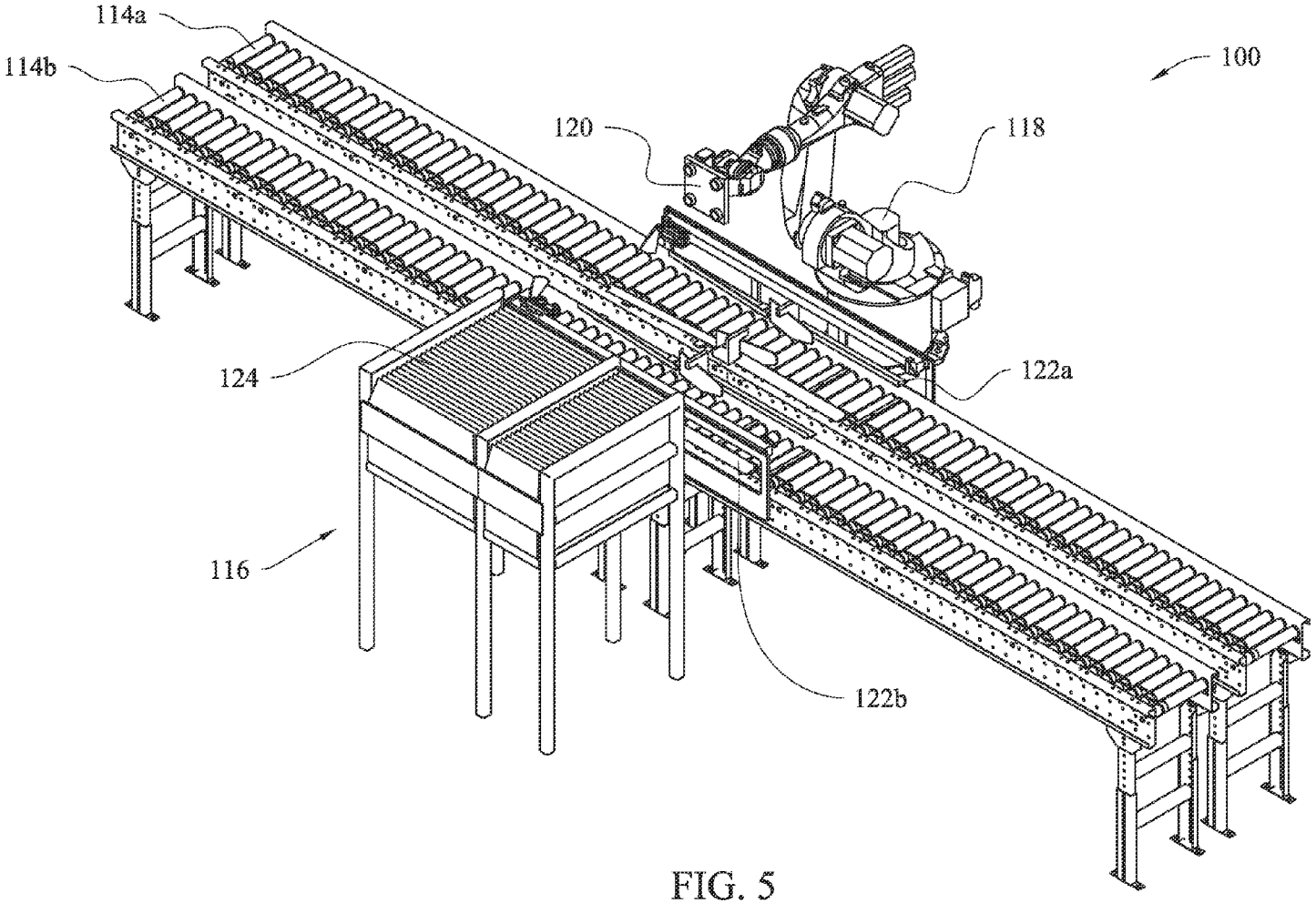
FIG. 5, is a perspective view of a robotic mail tray sleeving system.
Figure 6:
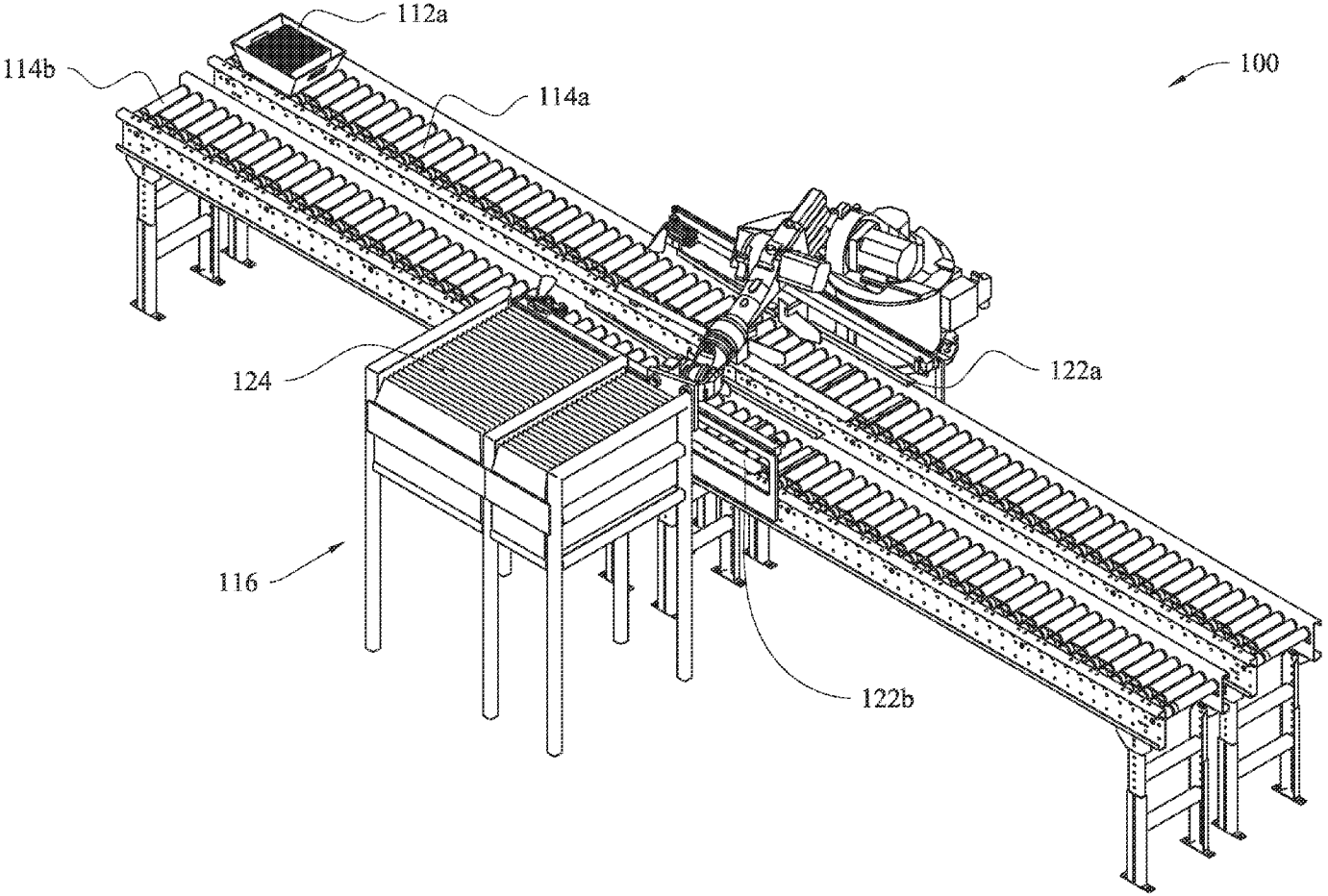
FIG. 6, is another perspective view of a robotic mail tray sleeving system.
Figure 7:
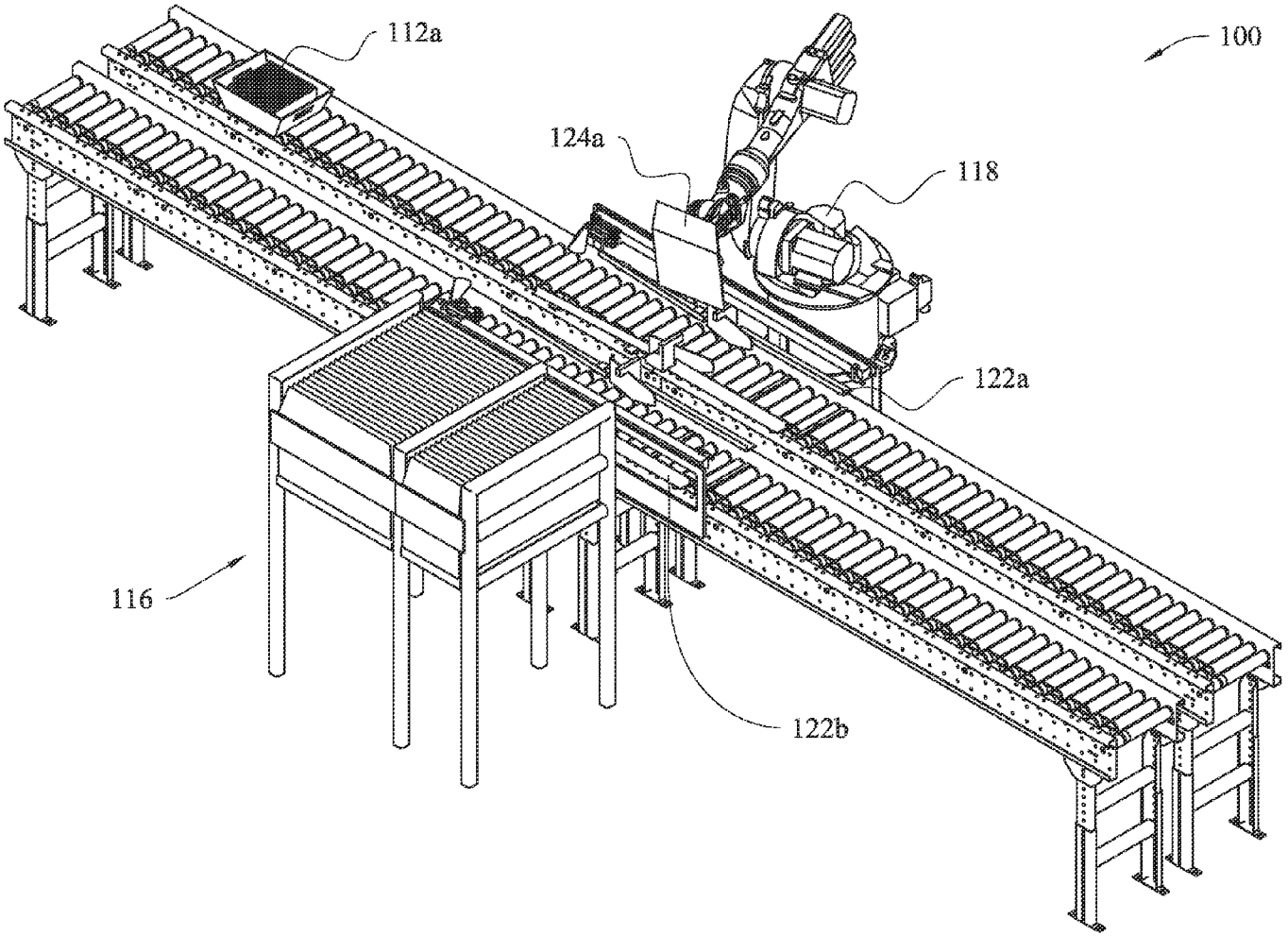
FIG. 7, is another perspective view of a robotic mail tray sleeving system.
Figure 8:
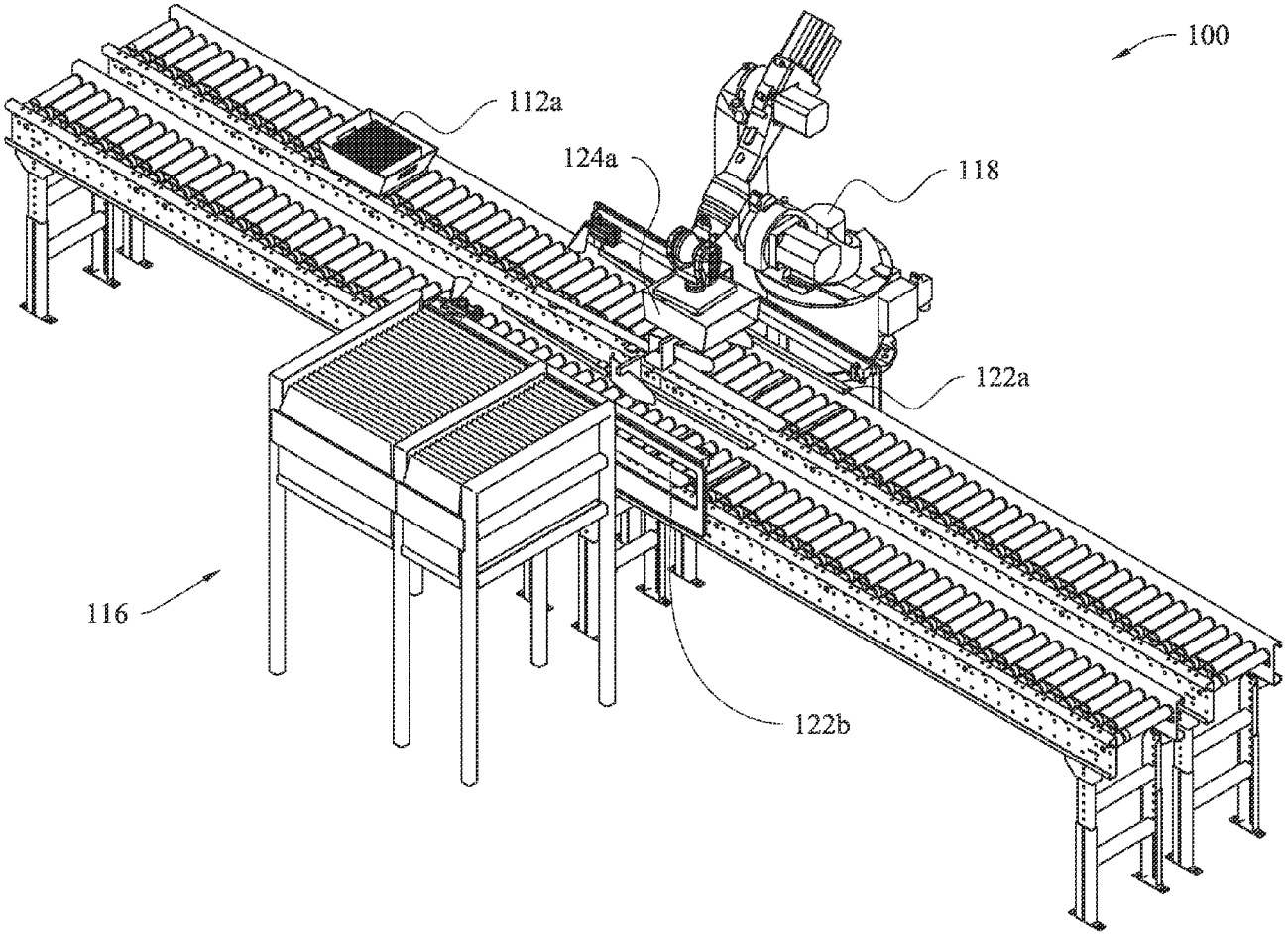
FIG. 8, is another perspective view of a robotic mail tray sleeving system.
Figure 9:
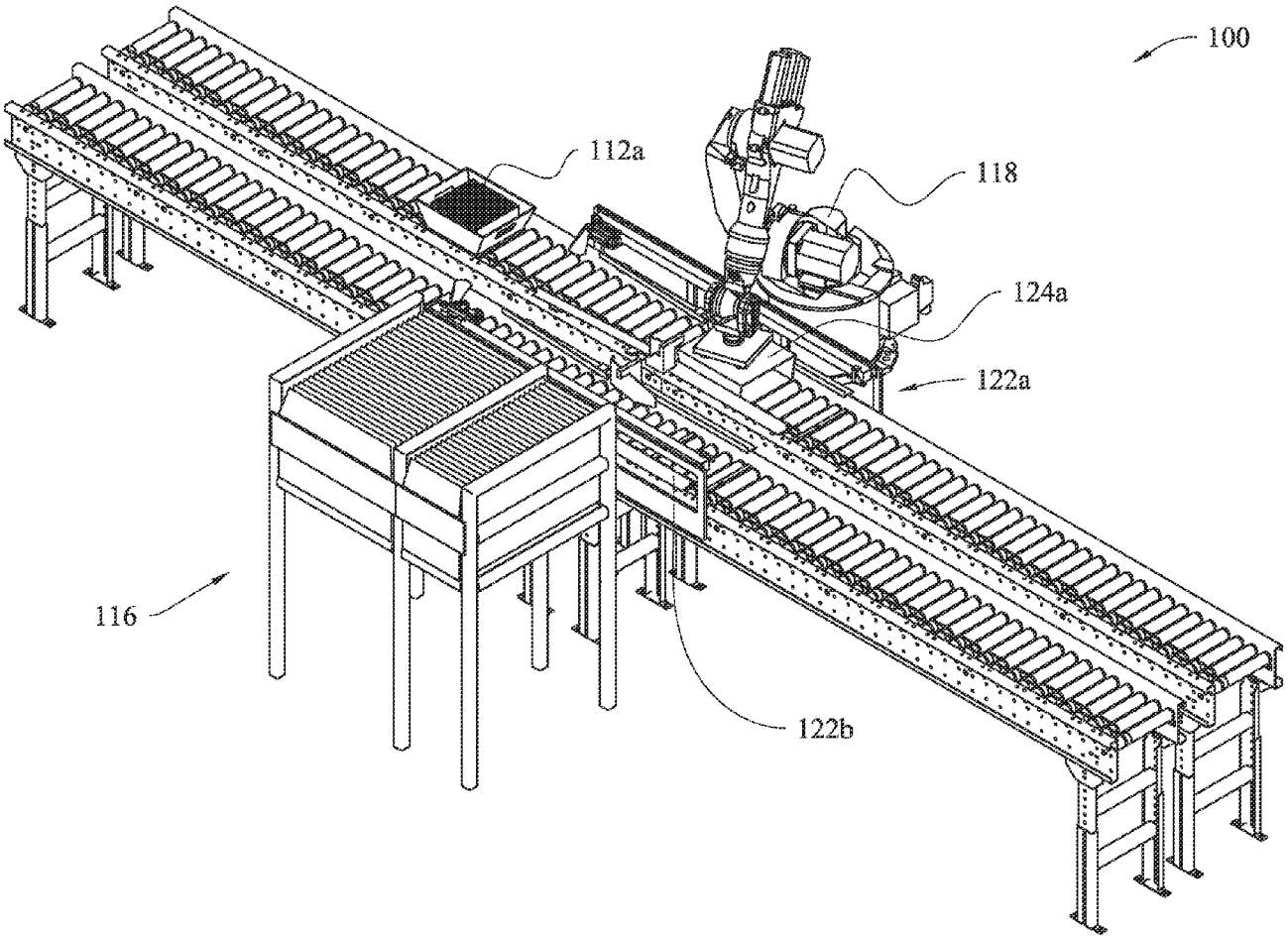
FIG. 9, is another perspective view of a robotic mail tray sleeving system.
Figure 10:
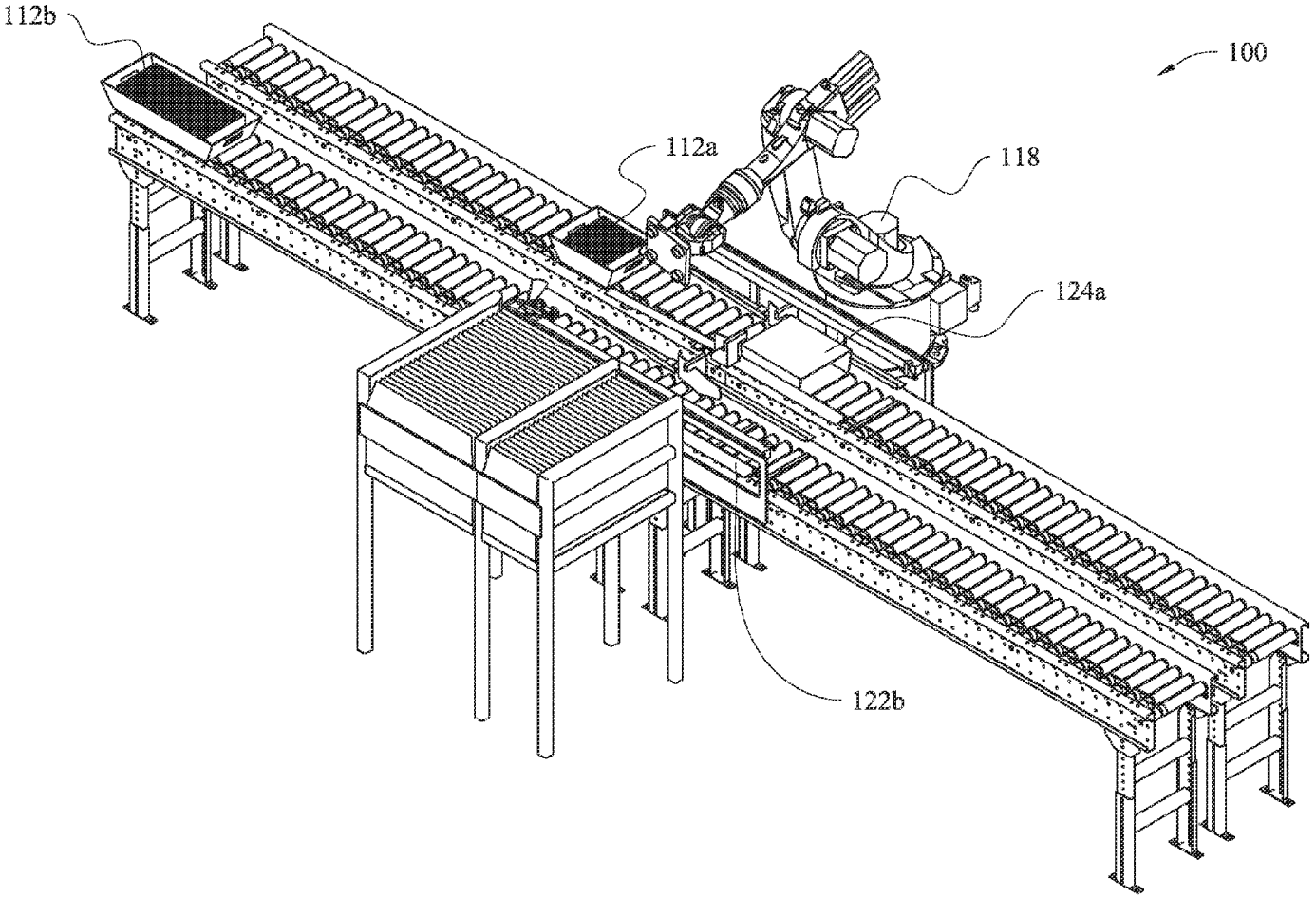
FIG. 10, is another perspective view of a robotic mail tray sleeving system.
Figure 11:
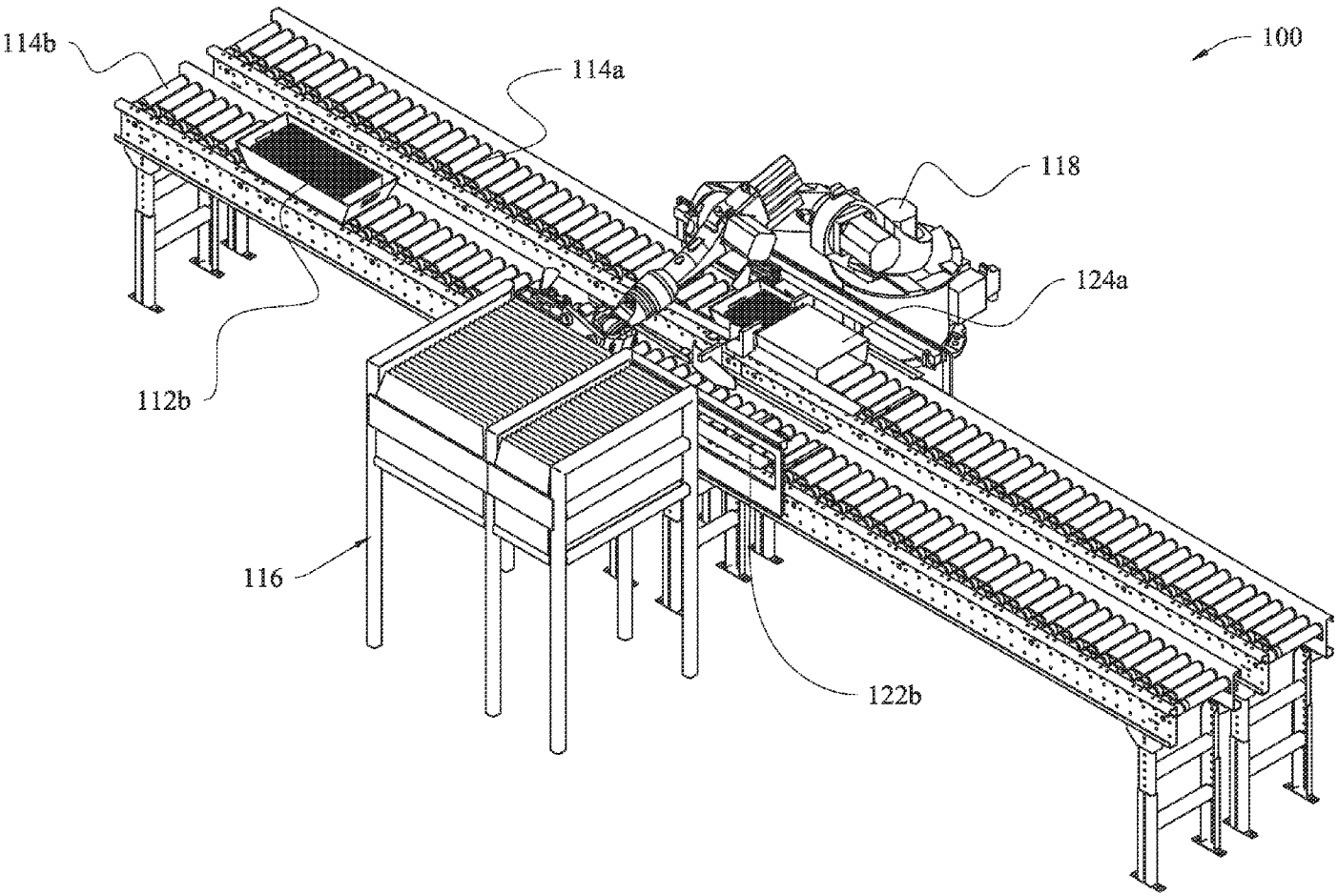
FIG. 11, is another perspective view of a robotic mail tray sleeving system.
Figure 12:
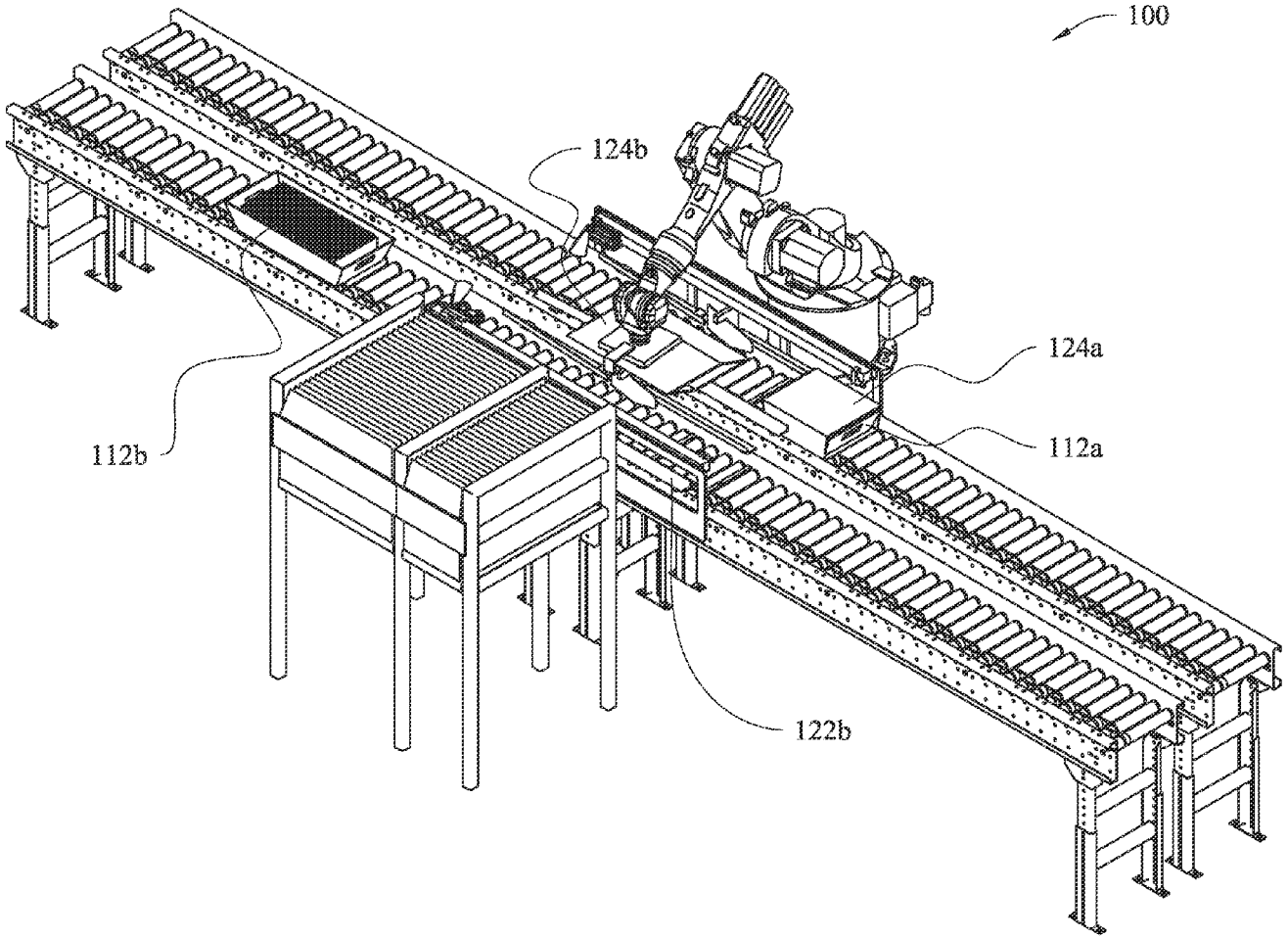
FIG. 12, is another perspective view of a robotic mail tray sleeving system.
Figure 13:
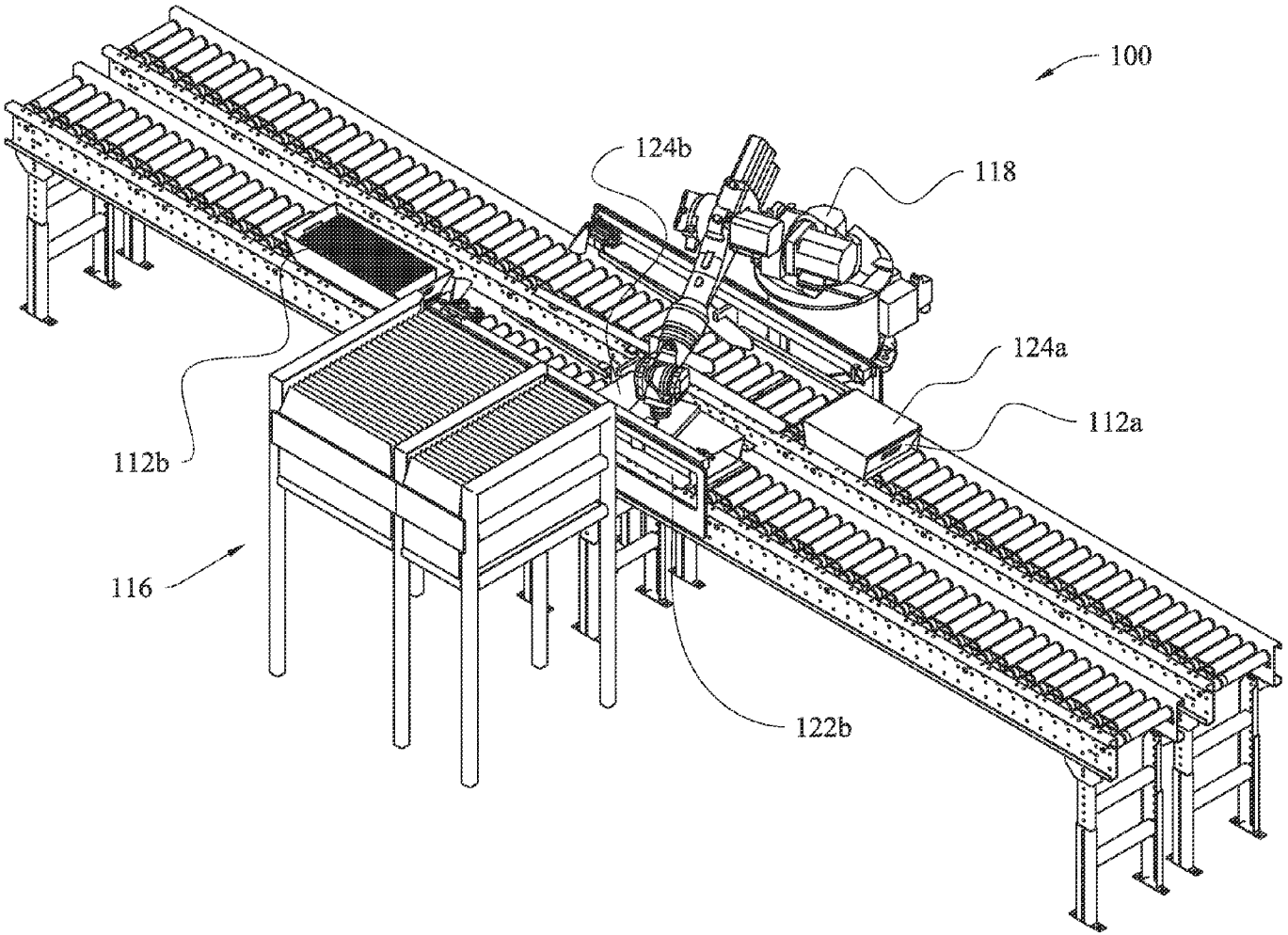
FIG. 13, is another perspective view of a robotic mail tray sleeving system.

Referring to FIGS. 5-13, a method of sleeving mail trays is illustrated using an embodiment of the robotic sleeving system disclosed herein. As shown in FIG. 5, system 100 begins a sleeving cycle with robotic arm 118 in a generic "home" position. In FIG. 6, robotic arm 118 engages a sleeve 124*a* in device 116 by means of the end of arm tooling 120. As shown in FIG. 7. robotic arm 118 moves sleeve 124*a* to a first conveyor line 114*a* on which a first tray 112*a* is travelling. In FIG. 8, the end of arm tooling is used to open sleeve 124*a* by exerting a force on a side surface of sleeve 124*a* in a way that biases sleeve 124*a* into an open position. In general, this operation may be carried out in a configuration such that gravity is also biasing sleeve 124*a* into the open position. In FIG. 9, sleeve 124*a* is placed onto tray induction system 122*a* as tray 112*a* advances. As shown in FIG. 10, after placing sleeve 124*a* on tray induction system 122*a*, end of arm tooling releases sleeve 124*a* and moves to repeat the process. In FIG. 11, robotic arm 118 uses end of arm tooling 120 to engage a second sleeve 124*b* and position sleeve 124 *b* proximate to a second conveyor line 114*b*. As shown in FIG. 12, the end of arm tooling 120 opens sleeve 124*b* similarly to how sleeve 124*a* was opened. In FIG. 13, sleeve 124*b* is placed on tray induction system 122*b* as tray 112*a*, now within sleeve 124*a*, advances past system 110.

In general, a method consistent with some embodiments would include the following steps:

(a) providing a conventional mail tray containing mail envelopes being transported on the conveyor;

(b) positioning a source of empty sleeves (i.e. device 16) in a position proximate to the conveyor;

(c) providing a robot including a multi-axis robot arm (i.e. arm 18) having a sleeve support and sleeve former (i.e. end of arm tooling 20) secured to an end thereof;

(d) positioning the robot relative to the conveyor and the source of sleeves so that the robot sleeve support and sleeve former may be moved therebetween;

(e) providing a tray entering a conveyor (i.e. conveyor 14) in a staging zone upstream of the robot, where sensors determine the tray type and/or size for the robot as the tray moves down the conveyor;

(f) causing the robot arm to move to the source of empty sleeves, pick the correct sleeve type/size using suction from the end of arm tooling, and to then position an empty sleeve in the end of arm tooling;

(g) forming the empty sleeve into the sleeve's ready (open) position while in motion toward the tray induction system (i.e. system 22);

(h) moving the robot arm while positively retaining the formed sleeve during motion so that the empty sleeve in the end of arm tooling is positioned at the tray induction system in the sleeve's open position;

(i) moving the end of arm tooling and the formed sleeve so as to place the formed sleeve onto the funnel device of the tray induction station;

(j) securing the opened sleeve in the tray induction station by means of the funnel device and movable stops as described herein;

(k) releasing the opened sleeve to the tray induction station from the robot by ending the end of arm tooling suction;

(l) sending the robot back to the source of sleeves so that the robot end of arm tooling may pick the correct sleeve type/size for the next tray entering a conveyor (i.e. conveyor 114*b*) at a point upstream of the robot where sensors determined the next tray type and/or size for the robot as the next tray moves down the conveyor;

(m) concurrently, while the robot is picking the next sleeve for the next tray, inducting the previous tray into the sleeve via a paddle device that pushes the tray into the opened sleeve along guided side rails contained within the tray induction station;

(n) discharging the sleeved tray from the tray induction station onto the conveyor;

(o) concurrently moving the robot arm and empty sleeve support from the source of empty trays for the next sleeve to the next tray induction station; and (p) similarly repeating the cycle for additional tray/sleeve sizes and/or types detected as the trays are transported down the conveyor.

Figure 14:
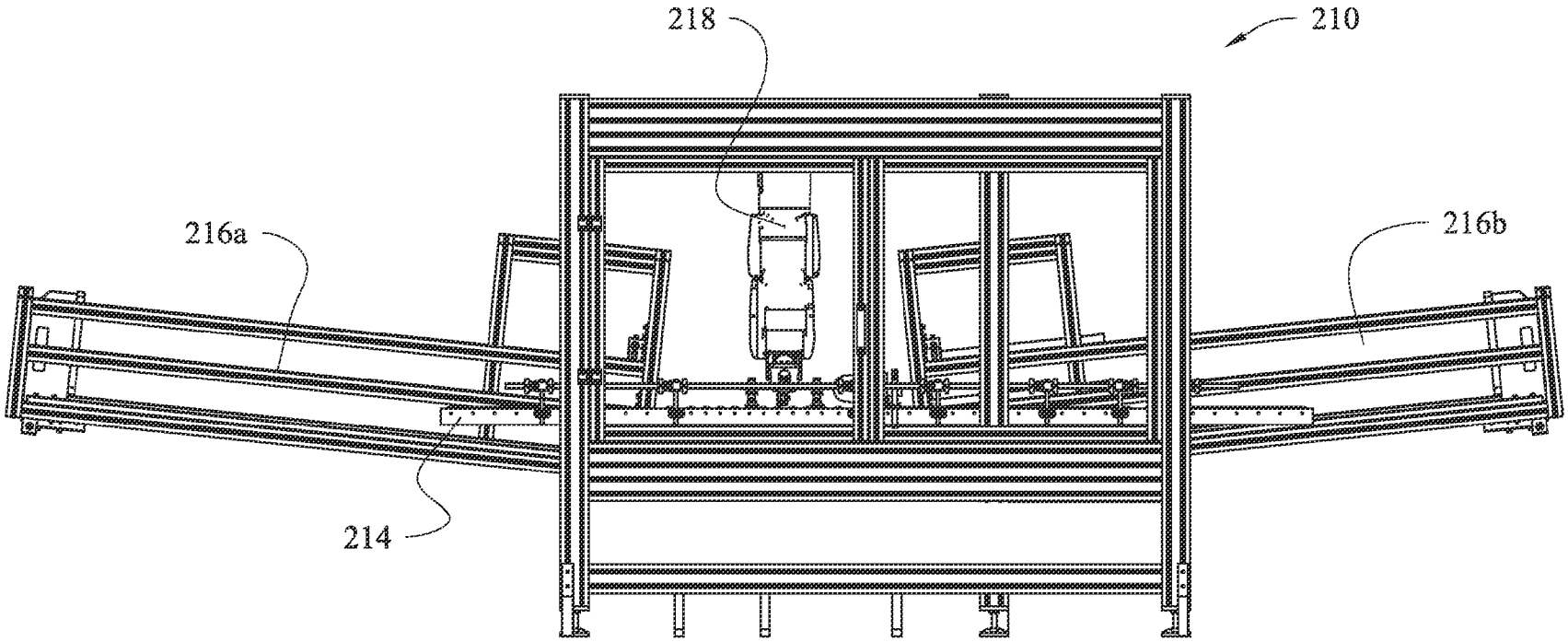
FIG. 14, is a side elevation view of a robotic mail tray sleeving system.
Figure 15:
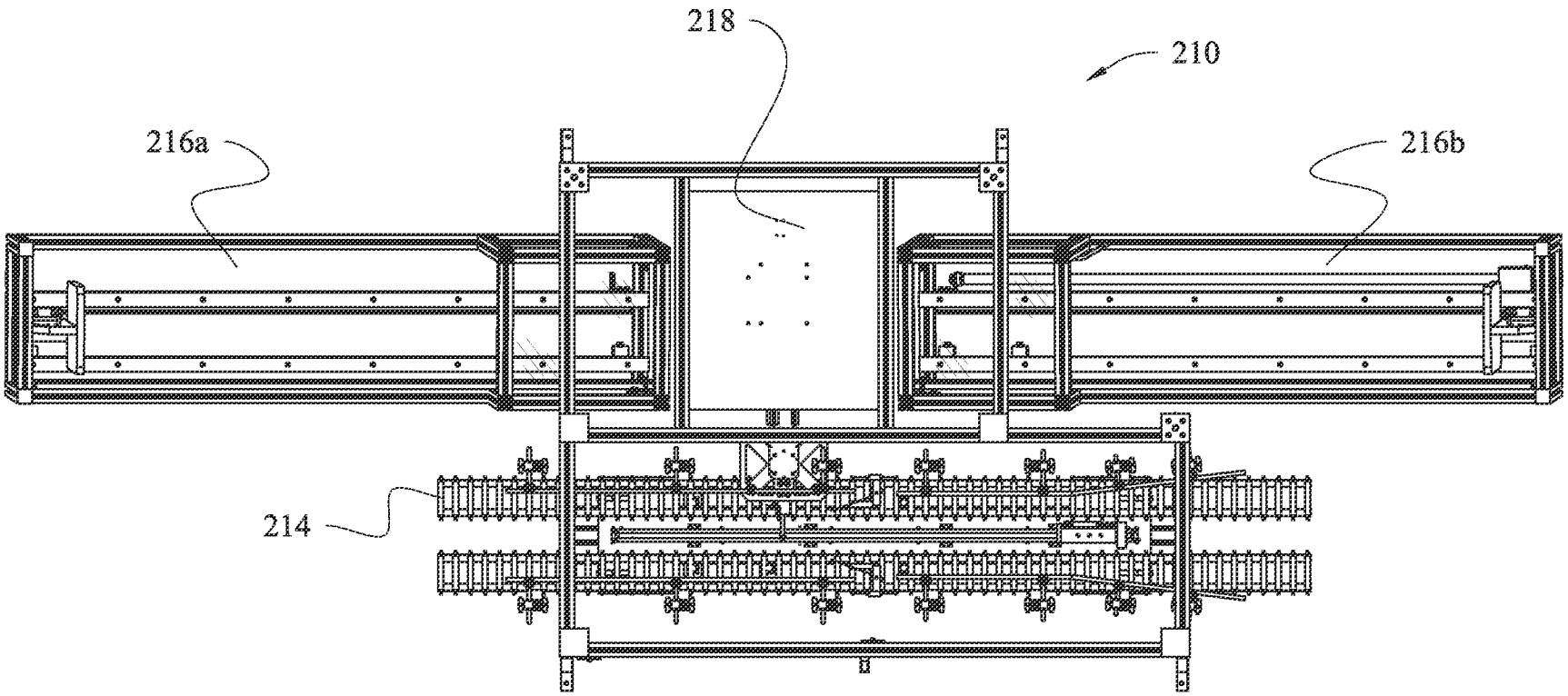
FIG. 15, is a top elevation view of a robotic mail tray sleeving system.
Figure 16:
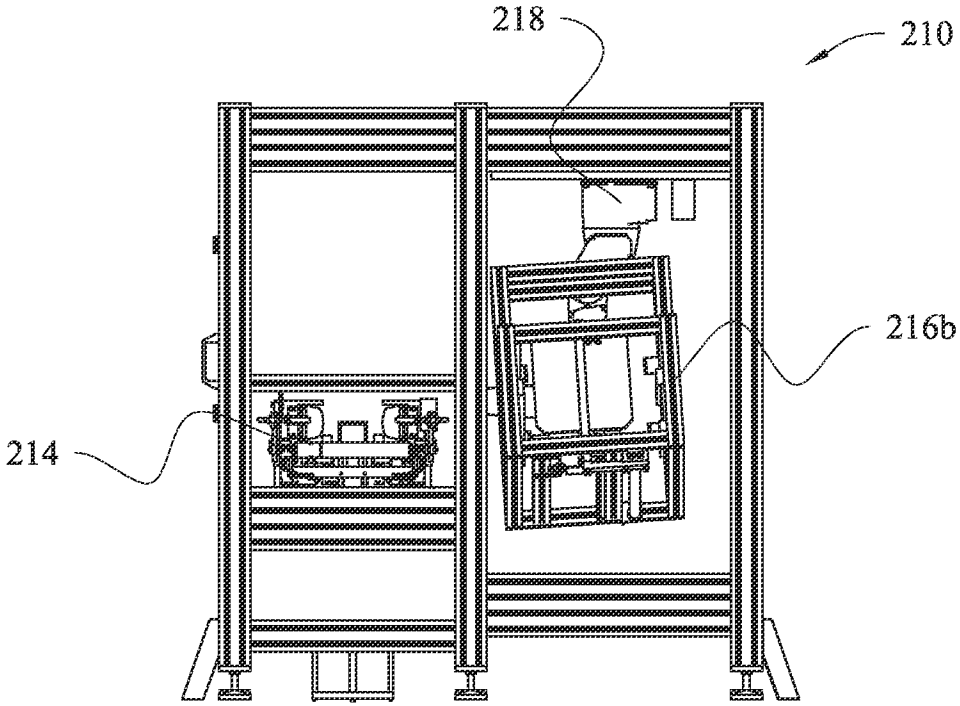
FIG. 16, is an end elevation view of a robotic mail tray sleeving system.

Referring to FIGS. 14-16, a robotic mail tray sleeving system 210 may include a conveyor 214 sleeve blank cartridges 216*a* and 216*b* (i.e. sleeve blank presentment devices), and a robotic arm 218. In a frame of reference where the front of a cartridge 216 is defined as the area closest to robotic arm 218, the cartridge is generally pitched downward and rolled towards conveyor 214. This allows the weight of the sleeve blanks to bias the sleeves into a consistent position at the front of the cartridge. In this way, the end of arm tooling attached to robotic arm 218 engages each successive sleeve blank at about the same point. Configuring the cartridges such that they extend in a plane that is roughly parallel to a plane that is normal to the top of conveyor 214, allows the overall system 210 to have a larger "on hand" supply of sleeve blanks while having a relatively small effective footprint. This configuration gives the robotic arm access to both sizes of mail tray sleeves and allows for the cartridges to be restocked "on the fly" which improves the average cyclic rate of the system over that of existing systems.

Figure 17:
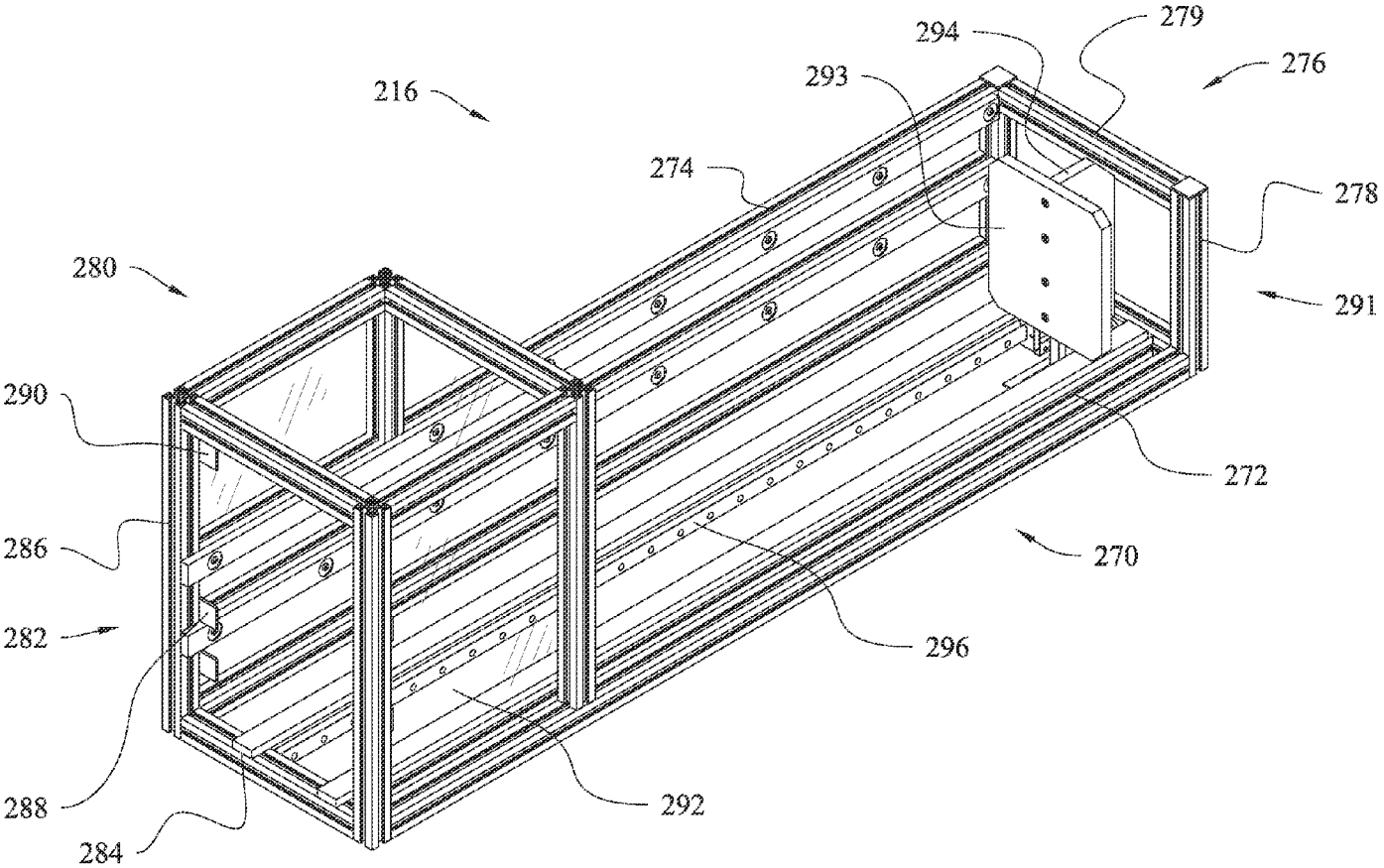
FIG. 17, is a perspective view of a sleeve blank cartridge for use in the system of FIG. 14.

Referring to FIG. 17, cartridge 216 comprises a frame 270 and a housing 282. Frame 270 includes a first set of longitudinal members 272 arranged in a plane and a second set of longitudinal members 274 arranged in another plane that is about perpendicular to the plane defined by members 272. These two sets of members form a frame having an "L" crossection in which sleeve blanks may be retained. The end of cartridge 216 is defined by frame portion 276 which includes a members 278 and a members 279 which are generally perpendicular to each other. Members 278 and 289 are configured to provide a rectangular end to frame 270. Housing 280 is positioned proximate to the front of cartridge 216 and is in the form of a rectangular prism having an open front formed by members 284 and members 286 that are roughly perpendicular to each other and form a rectangle. The housing extends back and includes additional members that at least define the edges of the rectangular prism. The sides and top of the housing may be fitted with clear panels 292 such that an operator can view the remaining sleeve blanks in cartridge 216 but be prevented access to pinch points that may cause injury.

Stops 288 and 290 are provided to secure the front most sleeve blank within cartridge 216. When robotic arm 218 engages the front most sleeve blank, that sleeve blank must be readily removeable, but only in such a way that the blanks behind the front most blank are retained. Accordingly, stops are provided to prevent the free movement of blanks out of cartridge 216 through the front of the cartridge. Stops 288 and 290 are positioned on at least two sides of the front face of the housing and are configured to be the sides to which the blanks are biased by the pitch and roll of the cartridge shown. Stops 288 and 290 may be mechanical stops that are retracted to allow a single blank to be removed. Alternatively, stops 288 and 290 may be flexible such that they deform from the force exerted by the robotic arm in removing the front most blank. Alternatively, stops 288 and 290 may be rigid. In that case, the sleeve blank may deform to pass by the stops when urged outward by the robotic arm. Because cartridge 216 is rolled in relation to a its major axis, stops along two sides are sufficient for rectangular sleeves of a variety of sizes.

A feeding device 291 is also provided. Feeding device 291 comprises a face plate 293 that bears against the rearmost sleeve blank when in use, and an orienting member 294. Orienting member 294 is coupled to face plate 293 and extends into a slot 296 that extend along much of the length of the cartridge. The positioning of orienting member 294 in slot 296 keeps face plate 293 in a generally constant position with respect to a crossection of cartridge frame 270. Feeding device 291 may urge the sleeve blanks towards the front of the cartridge by its own weight as the cartridge has a downward pitch. In some embodiments, feeding device 291 may be driven pneumatically or otherwise to allow an operator to move feeding device 291 to the back of cartridge 216 in order to facilitate the restocking of sleeve blanks.

Figure 18:
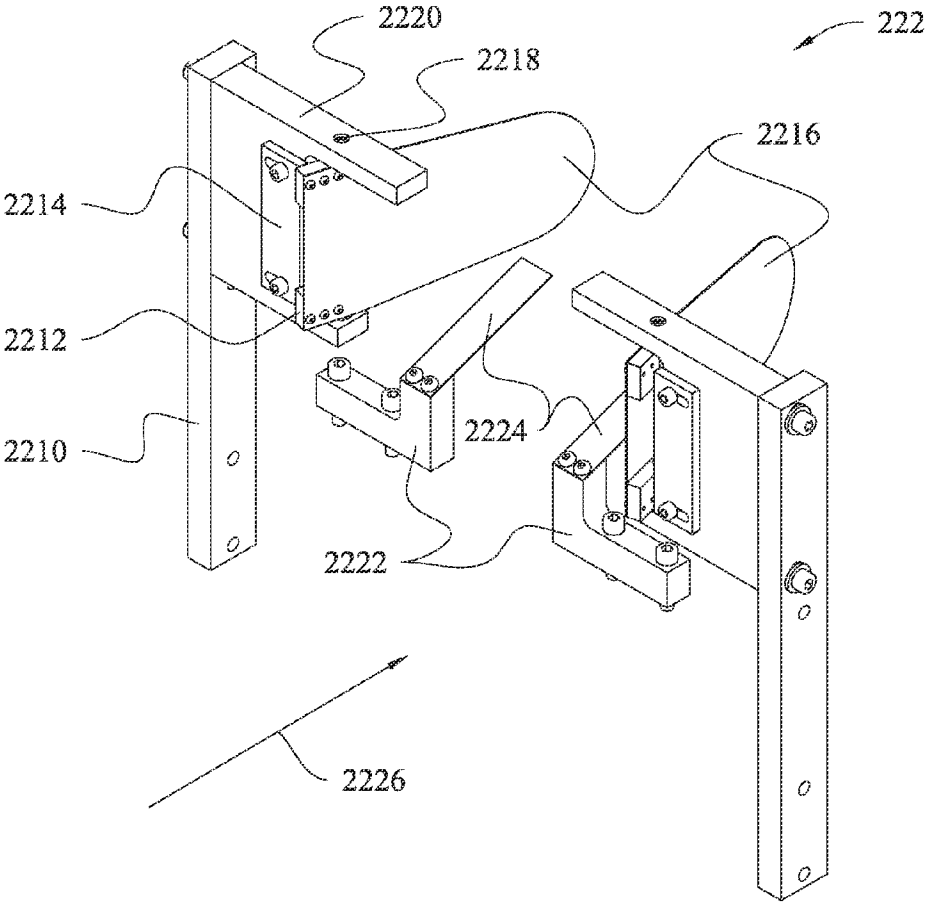
FIG. 18, is a perspective view of a tray induction system for use in the system of FIG. 14.

Referring to FIG. 18 a tray induction system 222 may comprise a vertical support 2210 may be coupled to a conveyor. Support 2210 may in turn be coupled to a 'U' shaped bracket 2212. A coupler 2214 may be used to attach a side paddle 2216 to bracket 2212. A stop 2218 may be used to prevent excessive outward deflection of paddle 2216. Additional brackets 2222 may be used to provide paddles 2224. The paddles may be made of a variety of materials, but a resilient material such as spring steel is desirable.

In use, vertical surface 2220 would bear against an open end of a sleeve. Paddles 2216 and 2224 would extend into a recess within the open sleeve and act as a funnel for a tray being urged into the sleeve along a direction indicated by arrow 2226.

Figure 19:
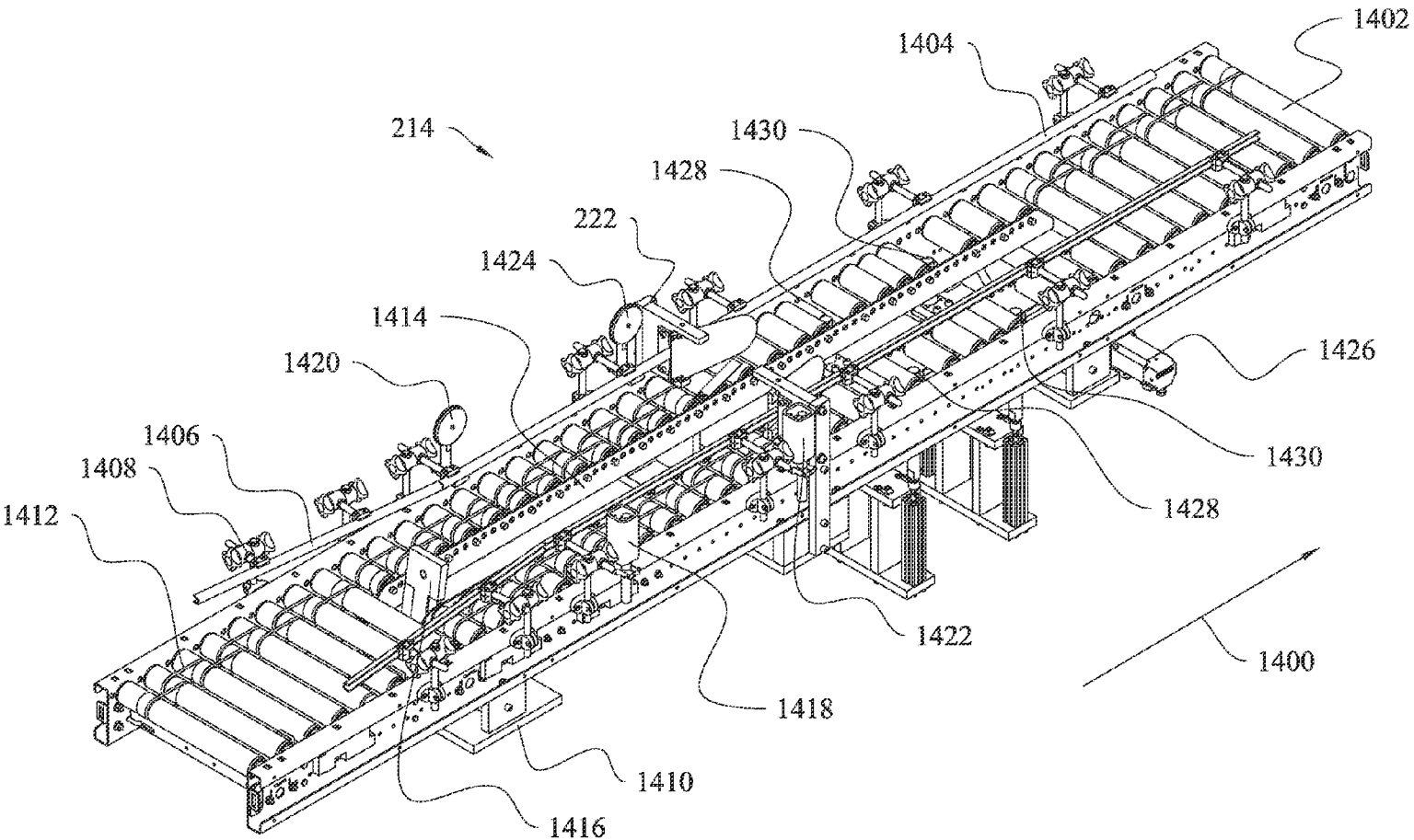
FIG. 19, is a perspective view of a tray conveyor for use in the system of FIG. 14.

Referring to FIG. 19, conveyor 214 is configured to direct mail trays in a direction parallel to arrow 1400. Conveyor 214 includes rollers 1402 mounted on a frame 1404. Guide rails 1406 direct and straighten the mail trays relative to their direction of motion and are mounted on rail supports 1408 which, in turn, are coupled to frame 1404. Supports 1410 may be used to secure conveyor 214 to a floor or other surface. Drive bands 1412 are used to transmit a drive force to the rollers 1402 along the length of conveyor 214. Conveyor 214 is also configured with a longitudinal opening 1414 in rollers 1402 that allows for the travel of a paddle 1416. Conveyor 214 may also include an emergency stop 1426

In use, paddle 1416 would be in a lowered position relative to the top surface of conveyor 214 until a mail tray is in position for insertion into a sleeve positioned on the opposite side of tray induction system 222. Once the tray is in position, the paddle raises and engages a trailing end of the tray to urge it through the funnel provided by tray induction system 222 and into the sleeve. Once that motion is complete, paddle 1416 may be used to advance the sleeved tray downstream of the tray induction system. Paddle 1416 may then be returned to the upstream end of opening 1414 to await another mail tray. Paddle 1416 may be kept in an up position to block a subsequent tray from reaching the tray induction system prematurely.

A first light generator/sensor 1418 is positioned along side conveyor 214 proximate to an upstream side of tray induction system 222. Light from generator/sensor 1418 travels along a path across conveyor 214 in a direction generally perpendicular to arrow 1400 but in a plane parallel to the top of rollers 1402. The light is reflected off of reflector 1420 and returns to light generator/sensor 1418 is detected by the sensor portion of light generator/sensor 1418. Light generator/sensor 1422 and reflector 1424 work in a similar manner to provide a light beam across the path of any mail trays. When the beam generated by the first light generator/sensor 1418 is broken, a computer may interpret this as indicating the presence of a tray to be sleeved. If, while this first beam is broken, the second beam generated by the second light generator/sensor 1422 is not broken, the system may interpret that set of conditions as indicating that a small tray (i.e. a Half size tray) is present. If, on the other hand, the first beam and the second beam are broken simultaneously, the system may interpret that to mean that a large tray (i.e. a Full size tray) is in position for sleeving. Based on these conditions, the system will decide which size sleeve the robotic arm should use for a given tray. Alternatively, a combination of MM and EMM sleeves, or EMM and Half EMM sleeves, or MM and Half MM sleeves may be used.

Two sets of sleeve stops 1428 and 1430 are also provided. In the case of a Full size sleeve, the set of sleeve stops 1430 are raised while the set of sleeve stops 1428 are lowered to prevent the sleeve from coming off of the tray induction system during insertion of the tray. The stops also prevent the tray from passing too far through the sleeve. In the case of a Half size sleeve, the set of sleeve stops 1428 will be raised to retain the sleeve and tray. Sleeve stops may be arranged in a variety of ways to accommodate any combination of MM, EMM, or Half MM trays and sleeves.

While optical sensors are disclosed, weight and electromagnetic sensors may also be employed. Further many portions of the conveyor system could be used without being directly coupled to the conveyor. For example, sensors or mechanical stops could be mounted to other equipment or surfaces and not to the conveyor frame. Additionally, optical sensors including photo-eyes may be used to determine if the tray induction system has been cleared before the system attempts to sleeve another tray. Such optical sensors may also be used to monitor the stock of sleeves available in the cartridges.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description of the invention herein is for the purpose of describing particular embodiments only and is not intended to be limiting of the invention. As used in the description of the embodiments of the invention and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Further, as used herein the term "plurality" refers to at least two elements. Additionally, like numbers refer to like elements throughout.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow. The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A robotic mail tray sleeving system comprising:

a conveyor system for transporting a mail tray;

a sleeve blank presentment device, the sleeve blank presentment device comprising a plurality of sleeve cartridges, each sleeve cartridge configured to hold a plurality of sleeve blanks in a generally vertical orientation;

a robotic arm;

an end of arm tool coupled to the robotic arm, the end of arm tool configured to retain and open a sleeve blank selected from the sleeve blank presentment device, the robotic arm configured to move the end of arm tool between a generally vertical orientation for selecting a sleeve blank from a sleeve cartridge and a generally horizontal orientation for placing the sleeve blank on the conveyor system, the end of arm tool comprising a base, a suction head, and an arm pivotally coupled to the base and configured to open a sleeve blank while the sleeve blank is retained by the suction head; and a tray induction system including a plurality of paddles configured to guide the mail tray into an opened sleeve blank, wherein each sleeve cartridge is pitched relative to a horizon such that the robotic arm is configured to remove a lower most sleeve blank from the sleeve cartridge.

2. The system of claim 1, wherein the conveyor system comprises a lateral opening and a paddle configured to advance a mail tray in a downstream direction.

3. The system of claim 1, wherein the conveyor system comprises a plurality of sleeve stops positioned downstream of the tray induction system.

4. The system of claim 1, wherein the conveyor system comprises sensors to determine the size of a mail tray.

5. The system of claim 4, wherein the sensors are optical sensors.

6. The system of claim 1, wherein the sleeve cartridge is rolled relative to a horizon such that sleeve blanks placed in the sleeve cartridge are biased towards a lower most corner.

7. The system of claim 1, wherein the sleeve cartridge includes a weighted feeding device to urge sleeve blanks within the cartridge towards an open end of the cartridge.

8. The system of claim 1, wherein the plurality of sleeve cartridges includes a first sleeve cartridge configured to feed a sleeve of a first size, and a second sleeve cartridge configured to feed a sleeve of a second size that is different than the first size.

9. A robotic mail tray sleeving system comprising:

a conveyor system for transporting a mail tray;

a sleeve blank presentment device, the sleeve blank presentment device comprising a plurality of sleeve cartridges, each sleeve cartridge configured to hold a plurality of sleeve blanks in a generally vertical orientation;

a robotic arm;

an end of arm tool coupled to the robotic arm, the end of arm tool configured to retain and open a sleeve blank selected from the sleeve blank presentment device, the robotic arm configured to move the end of arm tool between a generally vertical orientation for selecting a sleeve blank from a sleeve cartridge and a generally horizontal orientation for placing the sleeve blank on the conveyor system, the end of arm tool comprising a base, a suction head, and an arm pivotally coupled to the base and configured to open a sleeve blank while the sleeve blank is retained by the suction head; and a tray induction system including a plurality of paddles configured to guide the mail tray into an opened sleeve blank.

10. The system of claim 9, wherein the conveyor system comprises a lateral opening and a paddle configured to advance a mail tray in a downstream direction.

11. The system of claim 9, wherein the conveyor system comprises a plurality of sleeve stops positioned downstream of the tray induction system.

12. The system of claim 9, wherein the conveyor system comprises sensors to determine the size of a mail tray.

13. The system of claim 12, wherein the sensors are optical sensors.

14. The system of claim 9, wherein the sleeve cartridge is rolled relative to a horizon such that sleeve blanks placed in the sleeve cartridge are biased towards a lower most corner.

15. A robotic mail tray sleeving system comprising:

a conveyor system for transporting a mail tray, the conveyor system comprising a first sleeve stop and a second sleeve stop positioned downstream of the first sleeve stop;

a sleeve blank presentment device, the sleeve blank presentment device comprising a plurality of sleeve cartridges, each sleeve cartridge configured to hold a plurality of sleeve blanks in a generally vertical orientation;

a robotic arm;

an end of arm tool coupled to the robotic arm, the end of arm tool configured to retain and open a sleeve blank selected from the sleeve blank presentment device, the robotic arm configured to move the end of arm tool between a generally vertical orientation for selecting a sleeve blank from a sleeve cartridge and a generally horizontal orientation for placing the sleeve blank on the conveyor system, the end of arm tool comprising a base, a suction head, and an arm pivotally coupled to the base and configured to open a sleeve blank while the sleeve blank is retained by the suction head; and a tray induction system including a plurality of paddles configured to guide the mail tray into an opened sleeve blank, wherein the first sleeve stop and the second sleeve stop are positioned downstream of the tray induction system, the first sleeve stop is configured to stop a sleeve blank having a first general size, and the second sleeve stop is configured to stop a sleeve blank having a second general size different than the first general size.

16. The system of claim 15, wherein the conveyor system comprises a lateral opening and a paddle configured to advance a mail tray in a downstream direction.

17. The system of claim 15, wherein the conveyor system comprises sensors to determine the size of a mail tray.

18. The system of claim 17, wherein the sensors are optical sensors.

19. The system of claim 15, wherein the sleeve cartridge is rolled relative to a horizon such that sleeve blanks placed in the sleeve cartridge are biased towards a lower most corner.

20. The system of claim 15, wherein the plurality of sleeve cartridges includes a first sleeve cartridge configured to feed a sleeve of a first size, and a second sleeve cartridge configured to feed a sleeve of a second size that is different than the first size.

* * * * *